US011364726B2

(12) United States Patent
Nielsen

(10) Patent No.: US 11,364,726 B2
(45) Date of Patent: Jun. 21, 2022

(54) FLUID DISPENSING SYSTEMS

(71) Applicant: HEWLETT-PACKARD DEVELOPMENT COMPANY, L.P., Spring, TX (US)

(72) Inventor: Jeffrey A. Nielsen, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/268,197

(22) PCT Filed: Dec. 26, 2018

(86) PCT No.: PCT/US2018/067529
§ 371 (c)(1),
(2) Date: Feb. 12, 2021

(87) PCT Pub. No.: WO2020/139323
PCT Pub. Date: Jul. 2, 2020

(65) Prior Publication Data

US 2021/0339537 A1 Nov. 4, 2021

(51) Int. Cl.
*B41J 2/175* (2006.01)
*B41J 2/165* (2006.01)

(52) U.S. Cl.
CPC ..... *B41J 2/17546* (2013.01); *B41J 2/16535* (2013.01); *B41J 2002/16573* (2013.01)

(58) Field of Classification Search
CPC ..... B41J 2/17546; B41J 2/16535; B41J 2002/16573
See application file for complete search history.

(56) References Cited

U.S. PATENT DOCUMENTS

| | | | | |
|---|---|---|---|---|
| 6,074,616 | A | 6/2000 | Buechler et al. | |
| 6,535,697 | B2 * | 3/2003 | Reihl | G03G 15/5079 399/109 |
| 6,887,429 | B1 | 5/2005 | Marshall et al. | |
| 6,984,012 | B2 * | 1/2006 | Asauchi | B41J 2/17546 347/19 |
| 7,880,617 | B2 | 2/2011 | Morris et al. | |
| 9,862,194 | B2 | 1/2018 | Gaston Llado | |
| 2005/0019213 | A1 | 1/2005 | Kechagia et al. | |
| 2006/0030049 | A1 | 2/2006 | Bhimani et al. | |
| 2007/0186923 | A1 | 8/2007 | Poutiatine et al. | |
| 2013/0065797 | A1 | 3/2013 | Silbert et al. | |
| 2016/0131672 | A1 | 5/2016 | Tieman et al. | |
| 2016/0271947 | A1 | 9/2016 | Yang | |
| 2017/0210137 | A1 | 7/2017 | Wagner | |

* cited by examiner

*Primary Examiner* — Sharon Polk
(74) *Attorney, Agent, or Firm* — Perry + Currier Inc

(57) ABSTRACT

An example fluid dispensing system includes a printhead assembly comprising a printhead to dispense a given fluid in a printing process; and a first memory storing an identifier of the given fluid. The example fluid dispensing system further includes an accessory to interact with the printhead in a cleaning process or a storage process. The example fluid dispensing system further includes a second memory that is located with the accessory. The example fluid dispensing system further includes a read-write device to: read the identifier of the given fluid from the first memory; read the second memory; and, when the second memory does not store a fluid identifier, write the identifier of the given fluid to the second memory.

15 Claims, 10 Drawing Sheets

FLUID DISPENSING SYSTEMS

BACKGROUND

Printhead assemblies that are generally used to dispense ink may be used to dispense reagents in medical diagnostic testing. There may be hundreds of such reagents used in such medical diagnostic testing.

BRIEF DESCRIPTION OF THE DRAWINGS

Reference will now be made, by way of example only, to the accompanying drawings in which.

Throughout the drawings, identical reference numbers designate similar, but not necessarily identical, elements.

DETAILED DESCRIPTION

Figure 1:
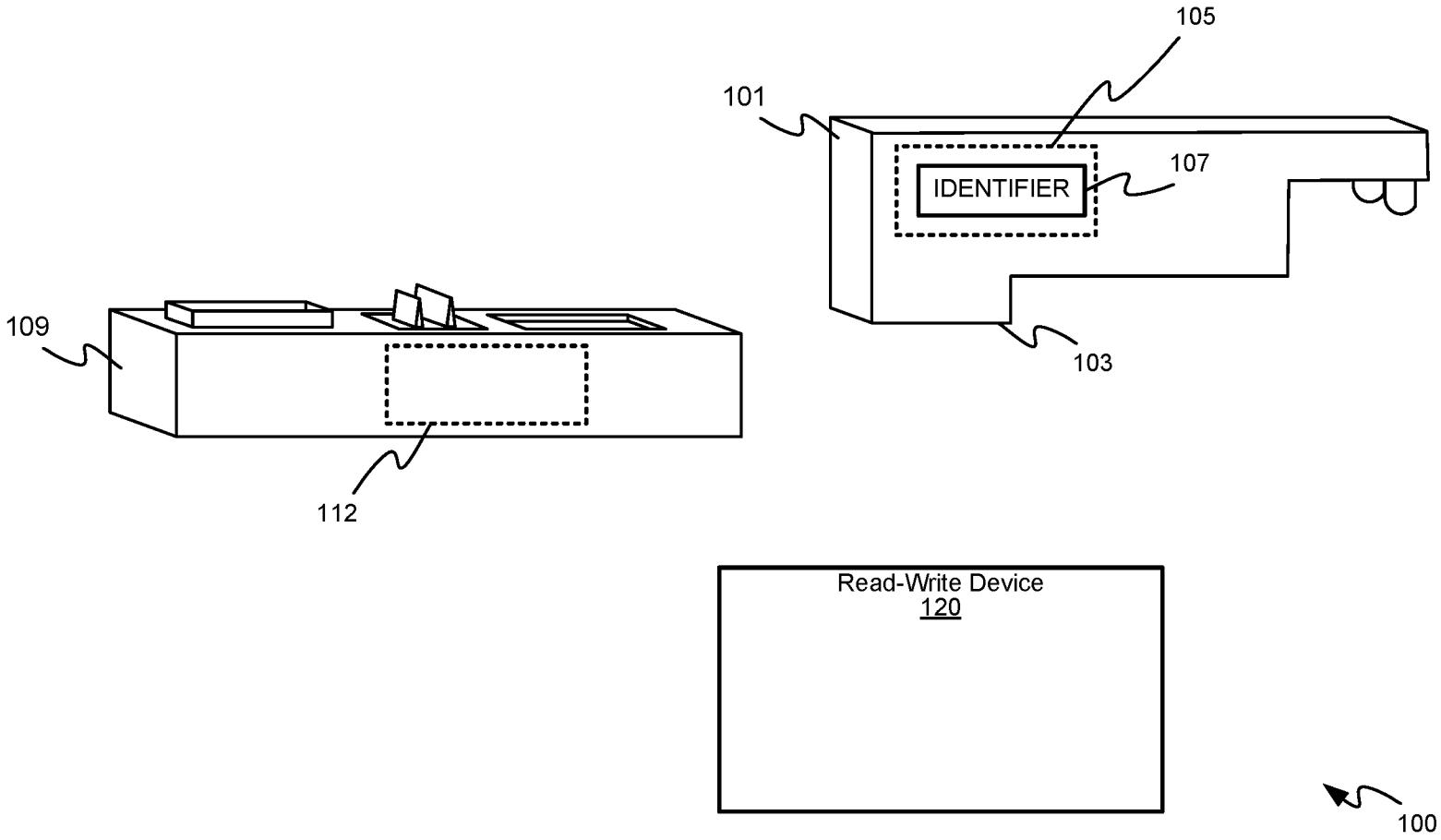
FIG. 1 shows a block diagram of an example fluid dispensing system.

Printhead assemblies that are generally used to dispense ink, for example to print on paper, may be used to dispense reagents in medical diagnostic testing, such as tissue staining a patient biopsy and/or sample. There may be hundreds of such reagents used in such medical diagnostic testing as compared to perhaps three or four different types of ink for printing on paper. Cleaning accessories and storage accessories, such as wipers and cap devices used with printheads of the printhead assemblies, may contaminate a printhead when the accessory has been previously used with a reagent and/or fluid that is different from a reagent and/or fluid being dispensed by the printhead. A similar problem exists with accessories used to convey a reagent and/or fluid from a cartridge to the printhead assembly. Hence, a significant technical problem with using printhead assemblies to dispense diagnostic reagents, and the like, is prevention of cross-contamination of the diagnostic reagents between the printhead assemblies. For example, contamination of a printhead assembly used to dispense a dye for cancer testing (e.g. when tissue staining a patient biopsy and/or sample) may result in a false positive or false negative of a test for cancer. Such a problem may not generally exist, and/or may not be as pertinent, when the printhead assemblies are used to dispense ink to print on paper, however cross-contamination between different colored inks may still occur.

Accordingly, an aspect of the specification provides a fluid dispensing system comprising: a printhead assembly comprising: a printhead to dispense a given fluid in a printing process; and a first memory storing an identifier of the given fluid; an accessory to interact with the printhead in a cleaning process or a storage process; a second memory that is located with the accessory; and a read-write device to: read the identifier of the given fluid from the first memory; read the second memory; and, when the second memory does not store a fluid identifier, write the identifier of the given fluid to the second memory.

The accessory may comprise a wiper to wipe the printhead during the cleaning process.

The accessory may comprise a cap device to cap the printhead during the storage process.

The accessory may comprise a service station used in the cleaning process or the storage process.

The accessory may comprise a service station including: a wiper to wipe the printhead during the cleaning process; a cap device to cap the printhead during the storage process; or a priming spittoon to receive excess fluid from the printhead during the cleaning process or the storage process.

Another aspect of the specification provides a method comprising: reading, using a read-write device, an identifier of a given fluid from a first memory associated with a printhead assembly, the given fluid dispensed by the printhead assembly; reading, using the read-write device, a second memory associated with an accessory to interact with the printhead assembly in a cleaning process or a storage process; and when the second memory does not store a fluid identifier, writing, using the read-write device, the identifier of the given fluid to the second memory.

The method may further comprise: reading, using the read-write device, the second memory at the accessory, the accessory comprising the second memory.

The method may further comprise: reading, using the read-write device, the second memory at a service station to hold the accessory, the service station The method may further comprise: when the second memory stores another fluid identifier different from the identifier of the given fluid, controlling, using the read-write device or a controller, a notification device to provide a notification thereof; and not writing, using the read-write device, the identifier of the given fluid to the second memory, or preventing the printhead assembly from being used with the accessory.

The method may further comprise: when the second memory already stores the identifier of the given fluid, writing, using the read-write device, a use indication of the accessory to the second memory.

Another aspect of the specification provides a non-transitory machine-readable storage medium encoded with instructions executable by a processor of a read-write device, the instructions to control the processor to: read an identifier of a given fluid from a first memory associated with a printhead assembly, the given fluid dispensed by the printhead assembly; read a second memory associated with an accessory to interact with the printhead assembly in a cleaning process or a storage process; and when the second memory does not store a fluid identifier, write the identifier of the given fluid to the second memory.

The instructions may further control the processor to: read the second memory at the accessory, the accessory comprising the second memory.

The instructions may further control the processor to: read the second memory at a service station to hold the accessory, the service station comprising the second memory.

The instructions may further control the processor to: when the second memory stores another fluid identifier different from the identifier of the given fluid, control a notification device to provide a notification thereof; and do not write the identifier of the given fluid to the second memory.

The instructions may further control the processor to: when the second memory already stores the identifier of the given fluid, write a use indication of the accessory to the second memory.

A further aspect of the specification provides a fluid dispensing system comprising: a printhead assembly comprising a first memory storing an identifier of a given fluid dispensed by the printhead assembly; a second memory; a cartridge storing the given fluid, the cartridge comprising a third memory storing the identifier of the given fluid; an accessory to fluidly connect the cartridge to the printhead assembly such that the given fluid flows from the cartridge to the printhead assembly via the accessory, the second memory associated with the accessory; and a read-write device to: read the identifier of the given fluid from the first memory or the third memory; read the second memory; and, when the second memory does not store a fluid identifier, write the identifier of the given fluid to the second memory.

The accessory may comprise the second memory.

The accessory may include a printed identifier, the second memory may be located remotely from the accessory, and the read-write device may be further to: read the printed identifier; and when the second memory does not store the fluid identifier, write the identifier of the given fluid to the second memory in association with the printed identifier.

The fluid dispensing system may further comprise a notification device, and the read-write device may be further to: when the second memory stores another fluid identifier different from the identifier of the given fluid, do not write the identifier of the given fluid to the second memory and control the notification device to provide a notification thereof.

The accessory may comprise: a first septum for connecting to the printhead assembly; a second septum for connecting to the cartridge; a tube for connecting the first septum and the second septum; or a combination thereof.

Referring to FIG. 1, a fluid dispensing system 100 is depicted (interchangeably referred to hereafter as the system 100). The system 100 comprises a printhead assembly 101 comprising: a printhead 103 to dispense a given fluid in a printing process; and a first memory 105 storing an identifier 107 of the given fluid. The system 100 further comprises an accessory 109 to interact with the printhead 103 in a cleaning process or a storage process. The system 100 further comprises a second memory 112 that is located with the accessory 109. The system 100 further comprises a read-write device 120 to: read the identifier 107 of the given fluid from the first memory 105; read the second memory 112; and, when the second memory 112 does not store a fluid identifier (e.g., as depicted), write the identifier 107 of the given fluid to the second memory 112. As depicted, the memories 105, 112 are depicted in outline to indicate that they may be internal to the printhead assembly 101 and the accessory 109.

The printhead assembly 101 may comprise a printhead assembly generally used for printing ink on paper, including, but not limited to, an inkjet printing printhead assembly, but adapted to dispense other types of fluids, such as diagnostic reagents. For example, the printhead assembly 101 may be used to dispense diagnostic dyes onto a tissue sample using the printhead 103, to test for cancer and/or other types of medical issues. As such, the printhead assembly 101 may be adapted for use in a medical diagnostic testing system that may include, but is not limited to, a conveyor system, and the like, for conveying slides carrying tissue samples (e.g. patient biopsy and samples) to the printhead assembly 101 for dispensing of a diagnostic reagent onto the tissue samples to stain the tissue samples. Indeed, the printhead assembly 101 may be one of a plurality of printhead assemblies arranged in groups along such a conveyor system. Each of the printhead assemblies in a group may dispense a different given fluid (e.g. different diagnostic reagents) for a given medical diagnostic test. Otherwise each of the printhead assemblies in the group may be similar to the printhead assembly 101. However, while present examples are described with respect to medical reagents, techniques described herein may be used when the printhead assembly 101 is dispensing any suitable type of fluid; for example, techniques used herein may be used when dispensing a fluid and/or drug to a patient using inkjet printing techniques.

While not depicted, the printhead assembly 101 may be engaged in a printhead stall, and the like which in turn may be connected to a mechanical system for positioning the printhead assembly 101 relative to the slides and/or the conveyor system. Indeed, when the printhead assembly 101 is arranged in a group of printhead assemblies, each printhead assembly may be engaged in a respective printhead stall, each of which may be connected to the mechanical system which positions the group of printhead assemblies relative to the slides and/or the conveyor system, for example under control by a controller and/or a computing device.

While not depicted, the printhead assembly 101 may be connected to a fluid cartridge, via a tube, and respective septums joining the tube to the printhead assembly 101 and the fluid cartridge (e.g. see FIG. 9, described below). When the printhead assembly 101 is one of a group of the printhead assemblies, each of the printhead assemblies in the group may be connected to a respective fluid cartridge. The fluid cartridge may also include a memory storing an identifier of the given fluid. Indeed, when the printhead assembly 101 and the fluid cartridge are provisioned to print the given fluid, a read-write device (which may include, but is not limited to, the read-write device 120) may write the identifier 107 of the given fluid to the first memory 105. Thereafter, the printhead assembly 101 is generally used to dispense the given fluid, and not other fluids, so as to not cross-contaminate the printhead 103 with other fluids.

The first memory 105 may be accessed via the read-write device 120 using electrodes and the like (not depicted) positioned on an external surface of the printhead assembly 101. Alternatively, the first memory 105 may be wirelessly accessed via the read-write device 120, for example via near-field communication (NFC) devices and/or radio-frequency identification (RFID) devices in the printhead assembly 101 and the read-write device 120. The first memory 105 may be internal to the printhead assembly 101 (as depicted) and/or the first memory 105 may be mounted on an external surface of the printhead assembly 101. In some examples, the first memory 105 comprises a flash memory, and the like.

As depicted, the accessory 109 comprises a service station used in a cleaning process or a storage process with the printhead assembly 101. The service station may include various accessories used in a cleaning process or a storage process with the printhead 103. For example, the service station may include (e.g. as depicted, from left to right): a cap device to cap the printhead 103 during a storage process; a wiper to wipe the printhead 103 during a cleaning process; and/or a priming spittoon to receive excess fluid from the printhead 103 during the cleaning process or the storage process. For example, the mechanical system for positioning the printhead assembly 101 may include components to move the printhead assembly 101 to various positions on the service station to dispense excess fluid from the printhead 103 into the priming spittoon and/or wipe fluid from the printhead 103 using the wipers and/or cap the printhead 103 using the cap device. Such positioning may occur under control of controller and/or a computing device.

However, while the accessory 109 is depicted as a service station that includes three accessories, the accessory 109 may be embodied as a wiper to wipe the printhead 103 during a cleaning process. Alternatively, the accessory 109 may be embodied as a cap device to cap the printhead 103 during a storage process. Indeed, the accessory 109 may comprise one accessory or more than one accessory, either grouped into a service station, or in respective holders, and the like.

Regardless, the second memory 112 is located with the accessory 109. In some examples, as depicted, the second memory 112 may be a component of the accessory 109. However, in other examples, the second memory 112 may be located with the accessory 109 but not a component of the accessory 109. For example, the accessory 109 may comprise a wiper and/or a cap device, each of which may not be large enough for the second memory 112 to be integrated therewith; in these examples, the second memory 112 may be located with the accessory 109 via a holder, and the like, of the accessory 109 (including, but not limited to, the depicted service station).

When the printhead assembly 101 is arranged in a group of printhead assemblies, the accessory 109 (e.g. the service station and/or a cap device and/or a wiper, and the like) may be one of a plurality of accessories arranged in a group to interact with a respective printhead of a respective printhead assembly of the group of printhead assemblies. Hence, for example, the mechanical system to position the group of printhead assemblies relative to the slides and/or the conveyor system, may also be to position the group of printhead assemblies relative to a group of accessories, in a one-to-one basis. Each of the accessories in the group of accessories may be similar to the accessory 109 (and/or the service station).

Hereafter, while the present specification is described with respect to one printhead assembly and one respective accessory (e.g. a service station), it is understood that that techniques and/or processes and/or devices described herein may be expanded to include a plurality of printhead assemblies arranged in a group and a plurality of accessories arranged in a group.

Similar to the first memory 105, the second memory 112 may be accessed via the read-write device 120 using electrodes (not depicted) and the like positioned on an external surface of the accessory 109. Alternatively, the second memory 112 may be accessed via the read-write device 120 wirelessly, for example via NFC devices and/or RFID devices in the accessory 109 and the read-write device 120. The second memory 112 may be internal to the accessory 109 (as depicted) and/or the second memory 112 may be mounted on an external surface of the accessory 109. In some examples, the second memory 112 comprises a flash memory, and the like.

Accordingly, the read-write device 120 may comprise any suitable device for reading the memories 105, 112, and writing at least to the second memory 112. Further, the read-write device 120 may be a component of the mechanical system to position the printhead assembly 101. Hence, the mechanical system may also be to position the read-write device 120 and/or the printhead assembly 101 and/or the accessory 109 and/or the second memory 112 such that the read-write device 120 may read the memories 105, 112 and at least write to the second memory 112. For example, when the memories 105, 112 are accessed via respective electrodes, the mechanical system may be to position respective corresponding electrodes of the read-write device 120 with the respective electrodes of the printhead assembly 101 and/or the accessory 109 read the memories 105, 112 and at least wirelessly write to the second memory 112.

Similarly, when the memories 105, 112 are accessed wirelessly, the read-write device 120 may include wireless components to read and write to the memories 105, 112, with the mechanical system adapted to position the read-write device 120 and/or the printhead assembly 101 and/or the accessory 109 and/or the second memory 112 such that the read-write device 120 may wirelessly read the memories 105, 112 and at least wirelessly write to the second memory 112. In some examples, the read-write device 120 may be attached to a robotic arm, and the like, which positions the read-write device 120 accordingly.

In yet further examples, the second memory 112 may be associated with the accessory 109 but not necessarily located with the accessory 109. For example, the accessory 109 may alternatively include a printed identifier, such as a barcode and the like. The printed identifier may comprise a unique part number of the accessory 109. In these examples, the second memory 112 may be located remotely from the accessory 109, and the read-write device 120 may be further to: read the printed identifier; and when the second memory 112 does not store a fluid identifier (e.g., in association with data corresponding the printed identifier, such as the unique part number, and the like), write the identifier 107 of the given fluid to the second memory 112 in association with the printed identifier (e.g., the data corresponding the printed identifier). In these examples, the read-write device 120 may include a reader of the printed identifier, including, but not limited to, a camera, a barcode reader, and the like.

Similarly, the first memory 105 may be associated with the printhead assembly 101 but not necessarily located with the printhead assembly 101. For example, the printhead assembly 101 may also include a respective printed identifier readable by the read-write device 120, with data corresponding to respective the printed identifier stored in association with the identifier 107 at the first memory 105. The respective printed identifier may comprise a unique part number of the printhead assembly 101. In these examples, the first memory 105 may be located remotely from the printhead assembly 101, and the read-write device 120 may be further to: read the respective printed identifier; and retrieve the identifier 107 from the first memory 105 using the respective printed identifier (e.g., the data corresponding the respective printed identifier).

Hence, the memories 105, 112 may be combined at a database device, and the like, and the read-write device 120 may be to access the database device in a wired or wireless, manner for example via a network, and the like.

Figure 2:
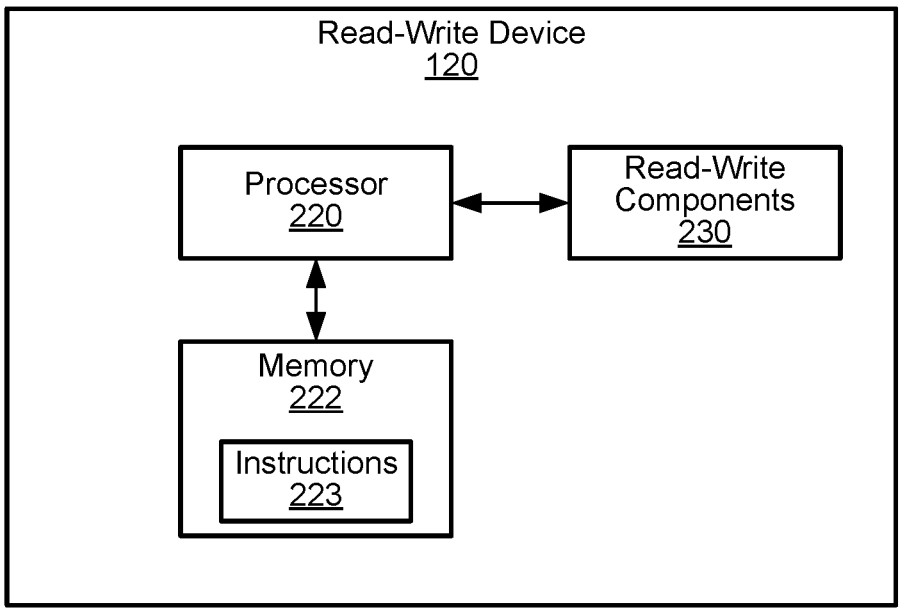
FIG. 2 shows a block diagram of an example read-write device.

Attention is next directed to FIG. 2 which depicts a block diagram of an example read-write device 120. As depicted, the example read-write device 120 comprises a processor 220, a memory 222 storing instructions 223 and read-write components 230. The processor 220 is connected to the memory 222 and the read-write components 230.

The read-write device 120 may include additional components, such as various additional interfaces and/or input/output devices such as display screens to interact with a user of the read-write device 120.

The read-write device 120 may further include and/or be in communication with, a notification device, such as a display screen, a speaker, a light emitting device, a haptic device and like, and/or any other notification device to provide notifications.

The read-write device 120 may further be in communication with a controller and/or computing device which controls positions of the components of the system 100 and/or general operation of the system 100.

The read-write components 230 are to read the memories 105, 112, and write at least to the second memory 112 in a wired and/or wireless manner, with the read-write components 230 adapted accordingly. For example, when the read-write components 230 are to read and write in a wired manner, the read-write components 230 may include, but are not limited to, electrodes for connecting to respective electrodes of the memories 105, 112. When the read-write components 230 are to read and write in a wireless manner, the read-write components 230 may include, but are not limited to, NFC and/or RFID components and the like. Regardless, the read-write components 230 are compatible with the reading the memories 105, 112, and writing at least to the second memory 112.

When the printhead assembly 101 and/or the accessory 109 include respective printed identifiers, as described above, and the first memory 105 and/or the second memory 112 is at a database device accessible via a network the read-write device 120 and/or the read-write components 230 may include: a camera, a barcode reader, and the like to read the respective printed identifiers; and a network interface to access the database device.

The memory 222 also stores the instructions 223 to read the memories 105, 112, and write at least to the second memory 112. The processor 220 is to execute the instructions 223 stored in the memory 222, the instructions 223 to control the processor 220 to: read the identifier 107 of a given fluid from the first memory 105 associated with the printhead assembly 101, the given fluid dispensed by the printhead assembly 101; read the second memory 112 associated with the accessory 109 (and/or located with the accessory 109), the accessory 109 to interact with the printhead assembly 101 (and/or the printhead 103) in a cleaning process or a storage process; and when the second memory 112 does not store a fluid identifier, write the identifier 107 of the given fluid to the second memory 112.

The memory 222 is coupled to the processor 220 and may include a non-transitory machine-readable storage medium that may be any electronic, magnetic, optical, or other physical storage device. The non-transitory machine-readable storage medium may include, for example, random access memory (RAM), electrically-erasable programmable read-only memory (EEPROM), flash memory, a storage drive, an optical disc, and the like. The memory 222 may also be encoded with executable instructions to operate the read-write components 230 and other hardware in communication with the processor 220. In other examples, it is to be appreciated that the memory 222 may be substituted with a cloud-based storage system.

The memory 222 may also store an operating system that is executable by the processor 220 to provide general functionality to the read-write device 120, for example, functionality to support various applications such as a user interface to access various features of the read-write device 120. Examples of operating systems include Windows™, macOS™, iOS™, Android™, Linux™, and Unix™. The memory 222 may additionally store applications that are executable by the processor 220 to provide specific functionality to the read-write device 120, such as those described in greater detail below and which may include the instructions 223.

The processor 220 may include a central processing unit (CPU), a microcontroller, a microprocessor, a processing core, a field-programmable gate array (FPGA), an application-specific integrated circuit (ASIC) or similar. The processor 220 and memory 222 may cooperate to execute various instructions such as the instructions 223.

The instructions 223 may be to further control the processor 220 to: read the second memory 112 at the accessory 109, when the accessory 109 comprises the second memory 112.

The instructions 223 may be to further control the processor 220 to: read the second memory 112 at a service station to hold the accessory 109, the service station comprising the second memory 112 and/or the accessory 109 comprising the service station.

The instructions 223 may be to further control the processor 220 to: when the second memory 112 stores another fluid identifier different from the identifier 107 of the given fluid, control a notification device to provide a notification thereof; and do not write the identifier 107 of the given fluid to the second memory 112.

The instructions 223 may be to further control the processor 220 to: when the second memory 112 already stores the identifier 107 of the given fluid, write a use indication of the accessory 109 to the second memory 112.

Figure 3:
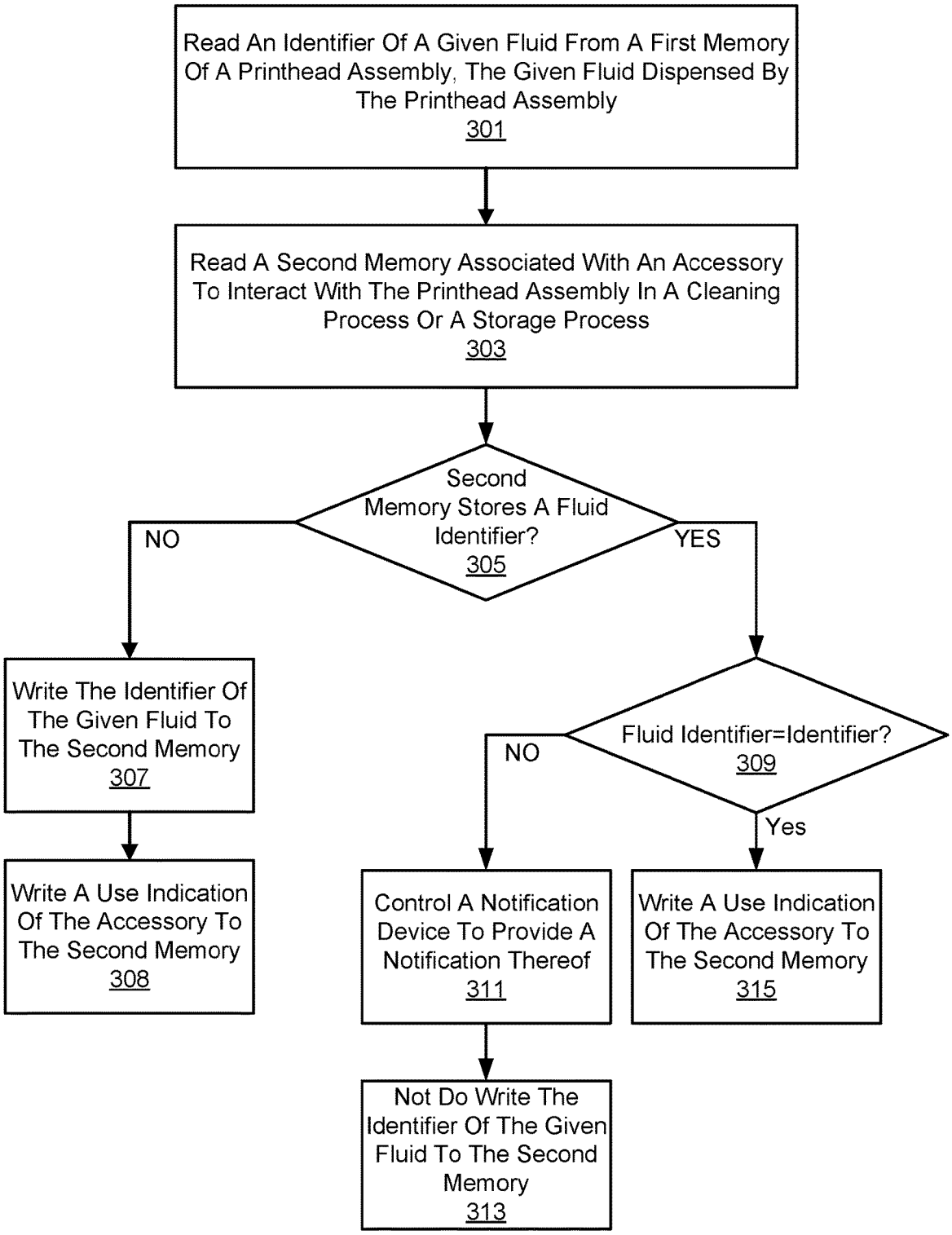
FIG. 3 shows a flowchart of an example of a method for writing to a memory associated with an accessory of a fluid dispensing system.

Referring to FIG. 3, a flowchart of a method 300 for writing to a memory associated with an accessory of fluid dispensing system is depicted. In order to assist in the explanation of method 300, it will be assumed that method 300 may be performed with the read-write device 120, and specifically by the processor 220. Indeed, the method 300 may be one way in which read-write device 120 may be to interact with the printhead assembly 101 and the accessory 109. Furthermore, the following discussion of method 300 may lead to a further understanding of the processor 220, the read-write device 120, the system 100 and its various components. Furthermore, it is to be emphasized, that method 300 may not be performed in the exact sequence as shown, and various blocks may be performed in parallel rather than in sequence, or in a different sequence altogether.

Furthermore, the method 300 is understood to initiate prior to the accessory 109 interacting with the printhead assembly 101 (e.g. the printhead 103) in a cleaning process or a storage process. For example the system 100 of FIG. 1 may further include a controller and/or a computing device of the mechanical system which positions the components of the system 100; prior to the controller and/or the computing device controlling the mechanical system to position the printhead assembly 101 and the accessory 109 to interact in a cleaning process or a storage process, the controller and/or the computing device may control the read-write device 120 to implement the method 300, for example to prevent contamination of the printhead 103, as described below.

Beginning at block 301, the processor 220 reads the identifier 107 of the given fluid from the first memory 105 of the printhead assembly 101, the given fluid dispensed by the printhead assembly 101, as described above.

At a block 303, the processor 220 reads the second memory 112 associated with the accessory 109, the accessory 109 to interact with the printhead assembly 101 (e.g. the printhead 103) in a cleaning process or a storage process.

At a block 305, the processor 220 determines whether the second memory 112 stores a fluid identifier. The second memory 112 may not store any fluid identifiers when the accessory 109 has not previously been used with a printhead assembly.

When the second memory 112 does not store a fluid identifier (a "NO" decision at the block 305), at a block 307 the processor 220 writes the identifier 107 of the given fluid to the second memory 112. In this manner, the accessory 109 is provisioned for use with the given fluid and/or mated, or paired, with the printhead assembly 101 and/or the given fluid dispensed by the printhead assembly 101.

In some examples, as depicted, at an optional block 308, the processor 220 writes a use indication of the accessory 109 to the second memory 112, as described below with respect to a block 315.

However, when the second memory 112 stores a fluid identifier (a "YES" decision at the block 305), at a block 309 the processor 220 determines whether the fluid identifier stored by the second memory 112 is another fluid identifier different from the identifier 107 of the given fluid, or whether the fluid identifier stored by the second memory 112 is the identifier 107 of the given fluid.

When the second memory 112 stores another fluid identifier different from the identifier 107 of the given fluid (a "NO" decision at the block 309), at an optional block 311, the processor 220 may control a notification device to provide a notification thereof; and, at a block 313, the processor 220 does not write the identifier 107 of the given fluid to the second memory 112. In particular, such a situation may occur when the accessory 109 was previously used with another given fluid and the read-write device 120 was used to write the identifier of the another given fluid in a previous implementation of the method 300. Hence, the processor 220 prevents the identifier 107 of the given fluid from being written to the second memory 112. The processor 220 may further prevent the accessory 109 from being used with the printhead assembly 101. For example, when the second memory 112 stores another fluid identifier different from the identifier 107 of the given fluid, the accessory 109 has previously being used with another fluid different from the given fluid dispensed by the printhead assembly 101. Hence, the processor 220 may take actions to prevent the accessory 109 from being used with the printhead assembly 101 to, in turn, prevent contamination of the printhead 103 by the other fluid. In some examples, the notification device providing a notification may cause an operator of the system 100 to manually replace the accessory 109. In other examples, the processor 220 may transmit a command to a controller and/or a computing device of the system 100 to cause the controller and/or the computing device to prevent the accessory 109 from being used with the printhead assembly 101.

Returning to the block 309, when the second memory 112 already stores the identifier 107 of the given fluid (a "YES" decision at the block 309), at an optional block 315, the processor 220 may write a use indication of the accessory to the second memory 112. In particular, such a situation may occur when the accessory 109 was previously used with the given fluid and the read-write device 120 was used to write the identifier 107 of the given fluid in a previous implementation of the method 300.

For example, when the accessory 109 comprises a wiper to wipe the printhead 103 during the cleaning process, the use indication may indicate a number of times the wiper has been used to wipe a printhead that uses the given fluid. Similarly, when the accessory 109 comprises a cap device to cap the printhead 103 during the storage process, the use indication may indicate a number of times the cap device has been used to cap a printhead that uses the given fluid. Hence, in combination with the block 308 (which may be similar to the block 315), the block 315 may be used to count a number of times the accessory 109 is used.

In yet further examples, indications of use written to the second memory 112 may be incremented during usage. For example, the processor 220 and/or the read-write device 120 may be further to: write an indication of use to the second memory 112 each time the accessory 109 is used. For example, when the accessory 109 comprises a wiper, the processor 220 and/or the read-write device 120 may be further to: write an indication of use to the second memory 112 each time the wiper is used to wipe the printhead 103. Similarly, when the accessory 109 comprises a cap device, the processor 220 and/or the read-write device 120 may be further to: write an indication of use to the second memory 112 each time the cap device caps the printhead 103. Similarly, when the accessory 109 comprises a priming spitton, the processor 220 and/or the read-write device 120 may be further to: write an indication of use to the second memory 112 each time the printhead 103 dispenses excess fluid in to the priming spittoon. In some of these examples, a controller and/or a computing device controlling use of the printhead assembly 101 with the accessory 109 may further control the read-write device 120 to write an indication of use to the second memory 112 each time the accessory 109 is used.

In yet further examples, indications of use written to the second memory 112 may be time-based. For example, the processor 220 and/or the read-write device 120 may be further to: write a start time of use of the accessory 109 (which may be referred to as an insertion time); and/or write an end time of use of the accessory 109 (which may be referred to as an extraction time). Hence, the processor 220 and/or the read-write device 120 may be further to record a total time that the accessory 109 is in use. Hence, for example, when the accessory 109 degrades over time due to contact with fluid and/or humidity and/or the like, the accessory 109 may be replaced and/or prevented from being used, when a threshold total use time is met and/or exceeded. In some of these examples, a controller and/or a computing device controlling use of the printhead assembly 101 with the accessory 109 may further control the read-write device 120 to write a start time of use of the accessory 109; and/or write an end time of use of the accessory 109.

Hence, at each use of the accessory 109, an indication of use is stored and/or incremented at the second memory 112. While not depicted, in some examples, when the accessory 109 has been used a given number of times (e.g. as determined by the read-write device 120 reading the number of use indications stored at the second memory 112), the accessory 109 may be discarded. For example, the block 303 (and/or any other suitable block) may include the read-write device 120 reading the number of use indications stored at the second memory 112 and determining whether the number of use indications meets and/or exceeds a threshold number of use indications; when the threshold number of use indications is met and/or exceeded, the read-write device 120 may prevent the printhead assembly 101 from being used with the accessory 109, for example, by communicating with a controller and/or computing device of the system 100 and/or controlling a notification device to provide a notification of the number of use indications meeting and/or exceeding the threshold number of use indications.

In general, via the method 300, the accessory 109 is "marked" and/or "paired" for use with a given fluid the first time the accessory 109 is used. Thereafter, the accessory 109 may be used with any printhead assembly that stores the identifier 107; however, the accessory 109 is generally prevented from being used by printhead assemblies that store fluid identifiers different from the identifier 107.

Attention is next directed to FIG. 4, FIG. 5, FIG. 6, FIG. 7 and FIG. 8 which depicts the system 100 being used to implement the method 300. In particular, each of FIG. 4, FIG. 5, FIG. 6, FIG. 7 and FIG. 8 is substantially similar to FIG. 1, with like components having like numbers. However, in FIG. 4, FIG. 5, FIG. 6, FIG. 7 and FIG. 8, the system 100 includes a notification device 401 and a controller 420 (which may be embodied as a computing device) in communication with the read-write device 120. The notification device 401 may include a display screen, a speaker, a light emitting device, a haptic device and like, and/or any other notification device to provide notifications The controller 420 may be to control the relative positions of the printhead assembly 101, and/or the accessory 109, and/or the read-write device 120, and/or the controller 420 may be to prevent the accessory 109 from being used with a printhead assembly, as described below.

Figure 4:
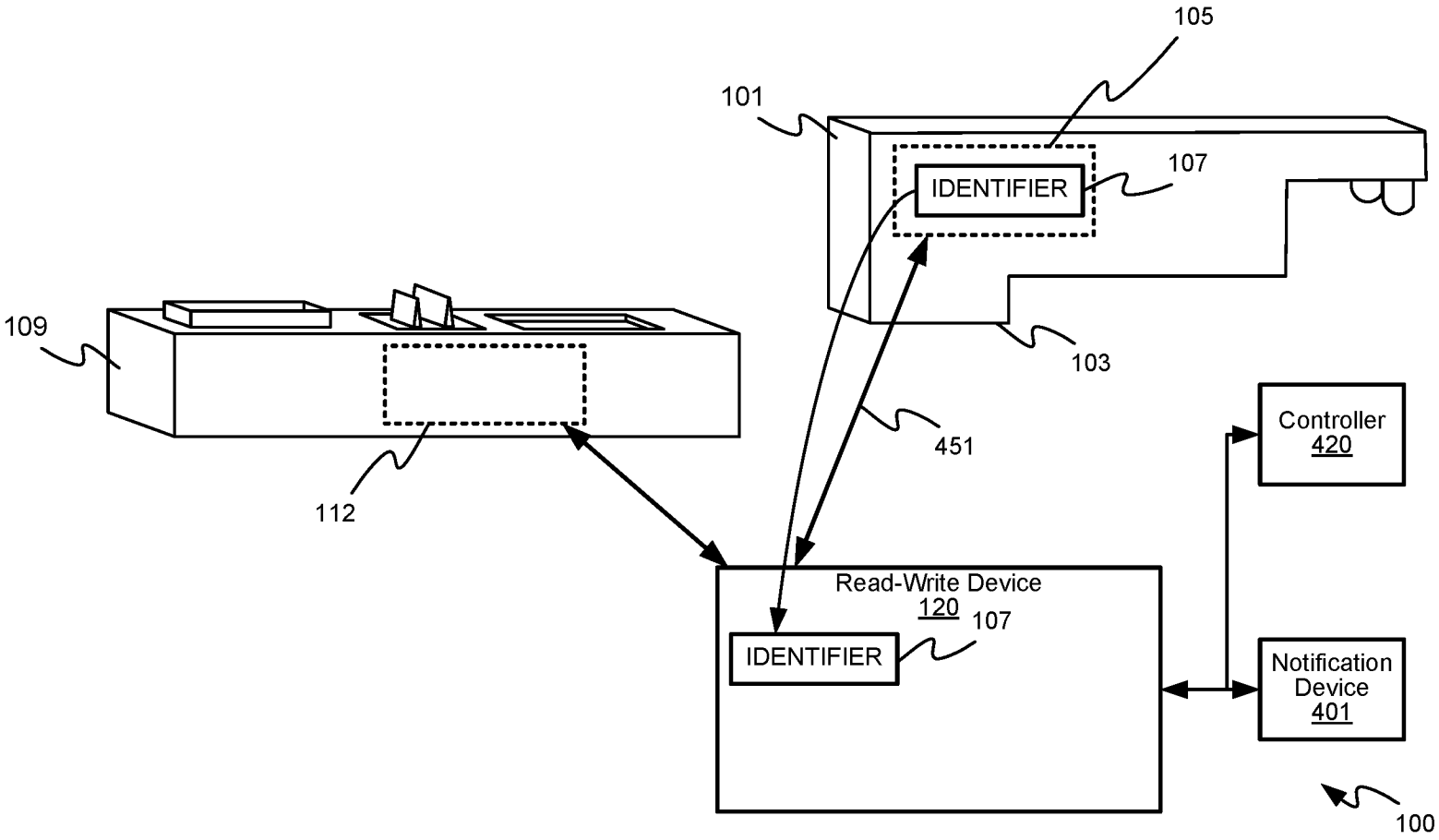
FIG. 4 shows the system of FIG. 1 implementing a portion of an example method for writing to a memory associated with an accessory of a fluid dispensing system.

With reference to FIG. 4, the second memory 112 does not store a fluid identifier. Hence, in FIG. 4, the accessory 109 has not previously been used with a printhead assembly. The accessory 109 may be manually mounted relative to the printhead assembly 101, for example in an accessory holder and the like.

As also depicted in FIG. 4, the read-write device 120 reads (e.g. at the block 301 of the method 300) the identifier 107 from the first memory 105, for example by establishing a wired or wireless link 451 with the first memory 105 (e.g., via respective electrodes and/or via respective NFC and/or RFID devices, and the like).

Figure 5:
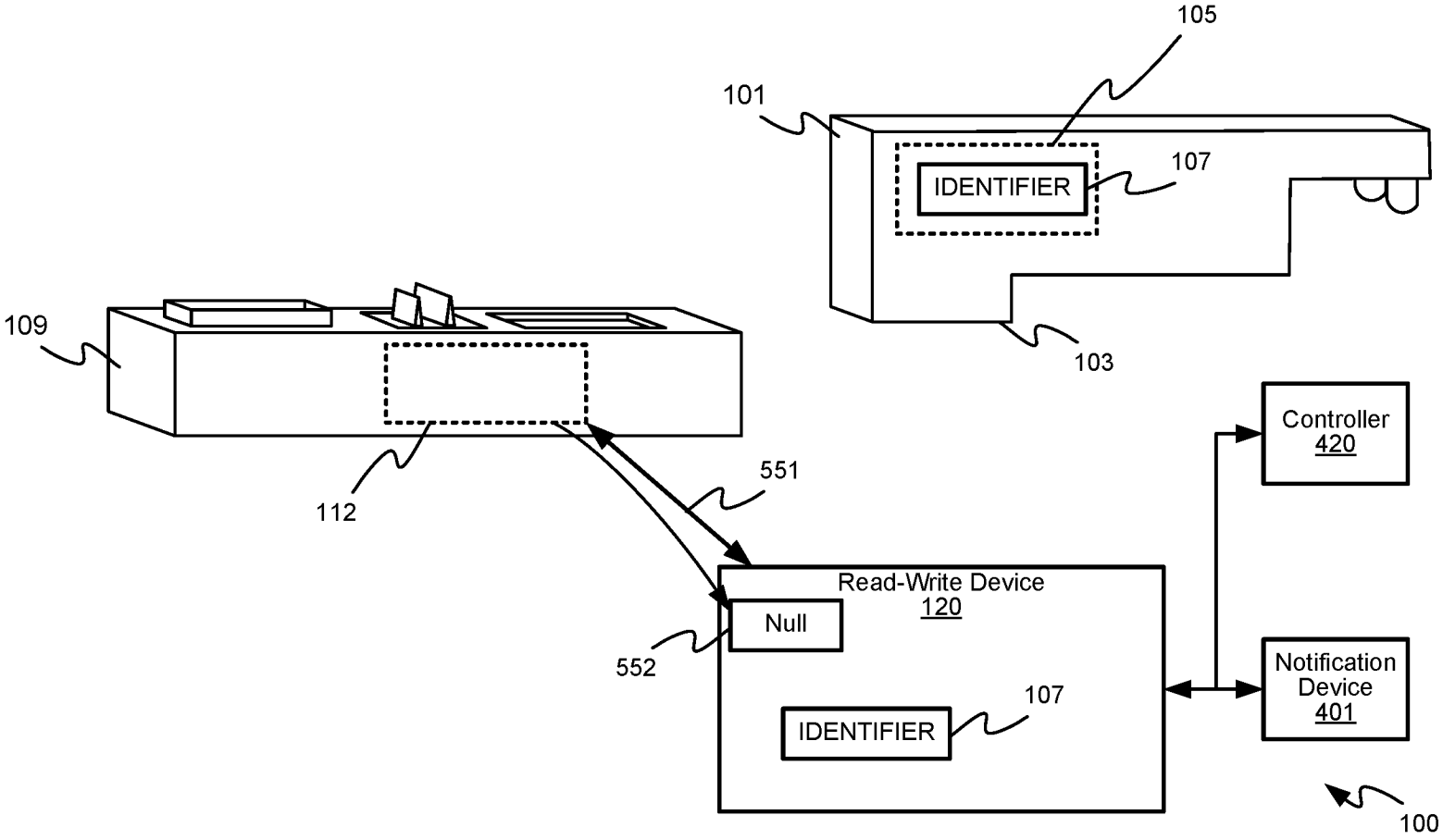
FIG. 5 shows the system of FIG. 1 implementing another portion of the example method for writing to a memory associated with an accessory of a fluid dispensing system.

As depicted in FIG. 5, the read-write device 120 reads (e.g., at the block 303 of the method 300) the second memory 112 by establishing a wired or wireless link 551 with the second memory 112 (e.g., via respective electrodes and/or via respective NFC and/or RFID devices, and the like). However, as the second memory 112 does not store a fluid identifier, the second memory 112 returns a null set 552, and the like, indicating that the second memory 112 does not store a fluid identifier (e.g. a "NO" decision occurs at the block 305).

Figure 6:
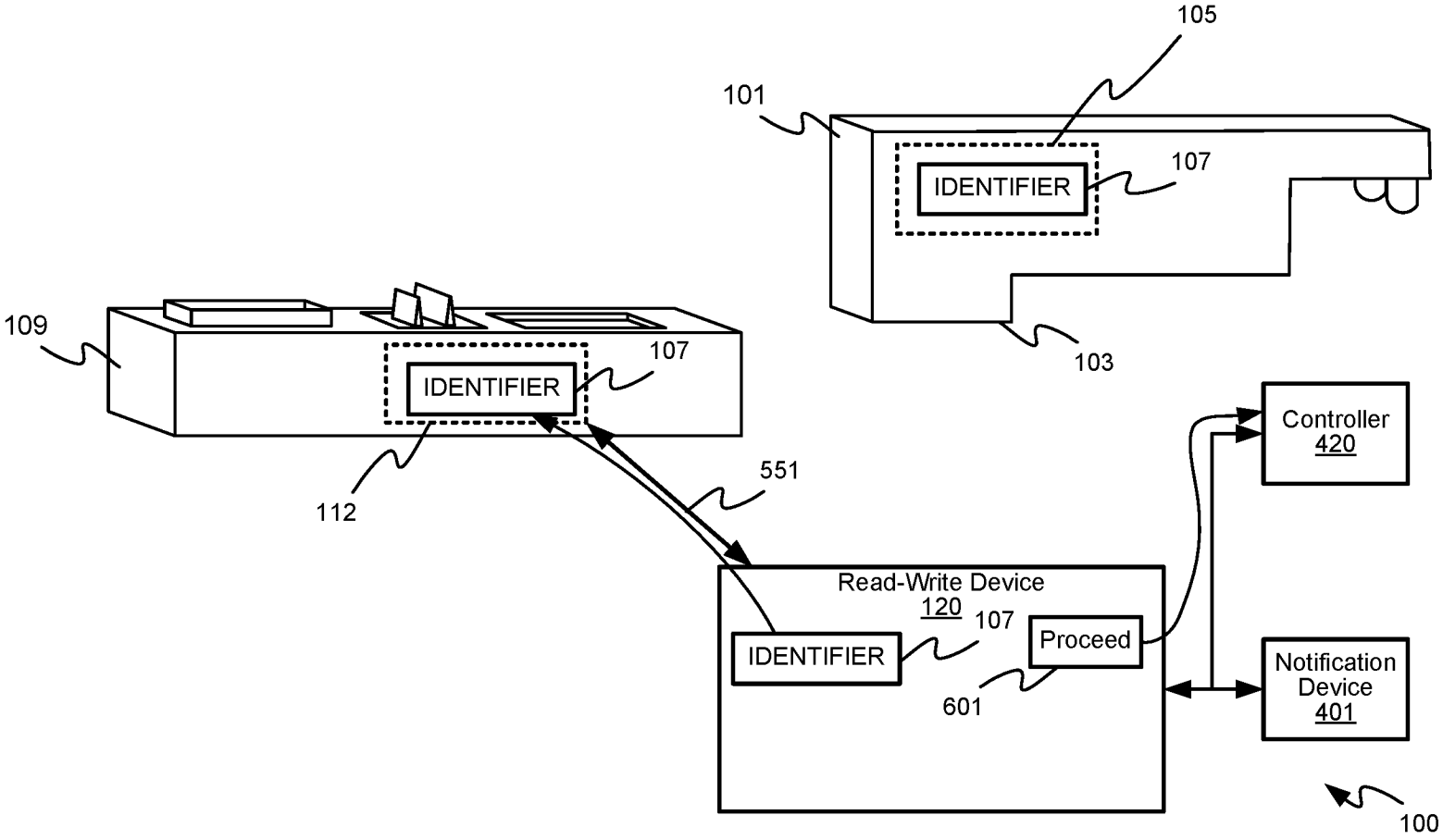
FIG. 6 shows the system of FIG. 1 implementing yet another portion of the example method for writing to a memory associated with an accessory of a fluid dispensing system.

As depicted in FIG. 6, as the read-write device 120 has determined (e.g., at the block 305 of the method 300) that the second memory 112 does not store a fluid identifier, the read-write device 120 writes the identifier 107 to the second memory 112 via the link 551. Hence, in this manner the accessory 109 is marked for use with, and/or paired with, the given fluid identified by the identifier 107.

As also depicted in FIG. 6, the read-write device 120 may transmit a command 601 to the controller 420 to indicate to the controller 420 that the controller 420 may proceed to control the printhead assembly 101 and the accessory 109 to interact in a cleaning process and/or a storage process. The controller 420 may then proceed to control the printhead assembly 101 and the accessory 109 to interact with each other to clean the printhead 103 via a priming spittoon 771, and/or via wipers 772, and/or the controller 420 may then proceed to control the printhead assembly 101 and the accessory 109 to interact with each other to cap the printhead 103 using a cap device 773. As depicted, each of the priming spittoon 771, the wipers 772, and the cap device 773 are components of the accessory 109 (e.g. as described above, the accessory 109 comprises a service station). While not depicted, the read-write device 120 may also write a use indication to the second memory 112 (e.g. at the block 308 of the method 300).

Figure 7:
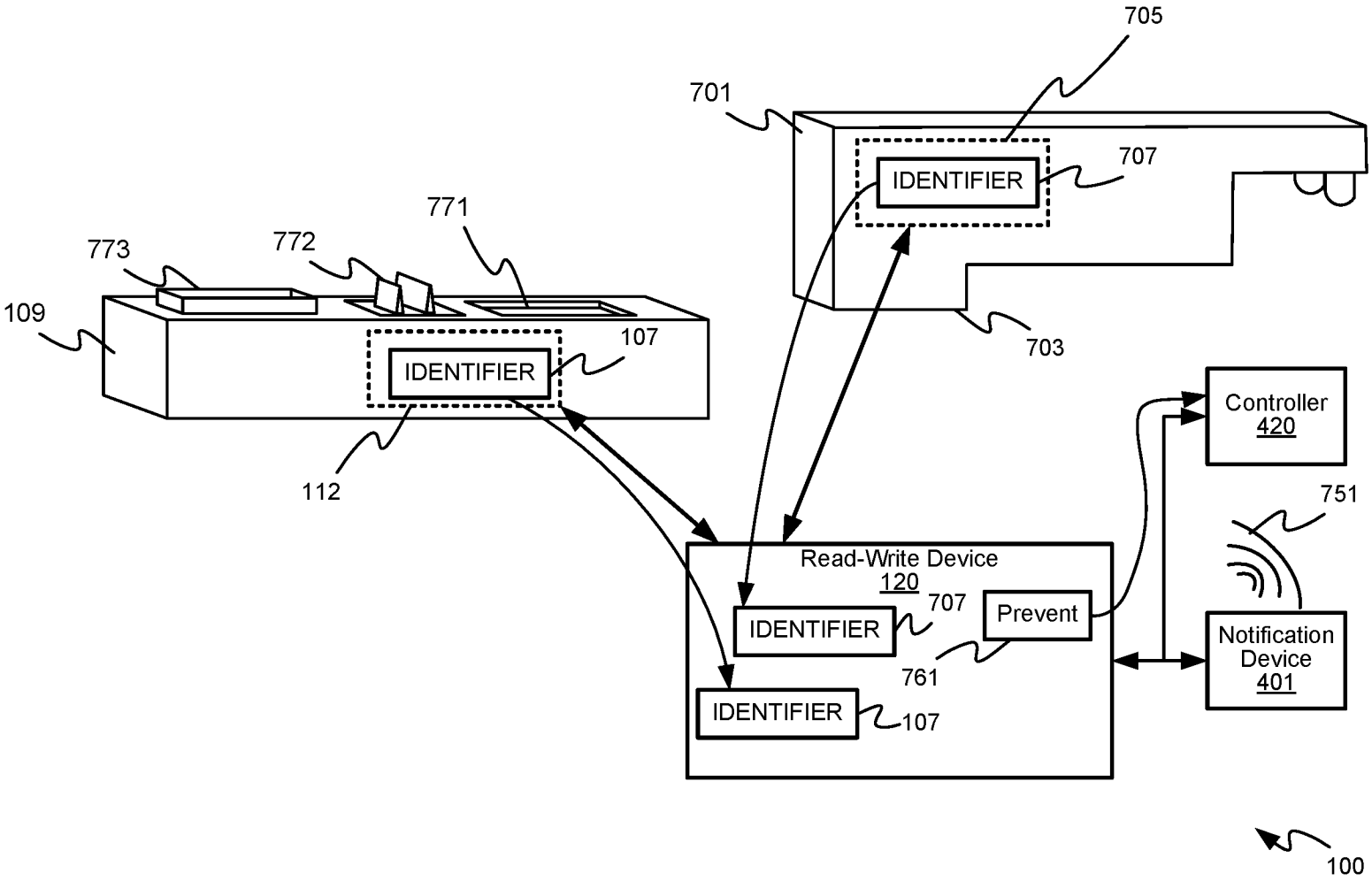
FIG. 7 shows the system of FIG. 1 implementing yet another portion of the example method for writing to a memory associated with an accessory of a fluid dispensing system.

Attention is next directed to FIG. 7, in which the accessory 109 stores the identifier 107, but the system 100 is now attempting to use another printhead assembly 701 with the accessory 109. The printhead assembly 701 is substantially similar to the printhead assembly 101 and hence comprises a respective printhead 703 and a respective memory 705. However, in contrast to the printhead assembly 101, the printhead assembly 701 is used to dispense a different given fluid identified by an identifier 707 which is different from the identifier 107. As such, when the read-write device 120 implements the method 300, at the block 301 and the block 303, the read-write device 120 reads the identifiers 707, 107 from the respective memories 705, 105 (e.g. via respective links).

The read-write device 120 determines, at the block 305, that the second memory 112 stores the identifier 107 and hence compares the identifiers 707, 107 at the block 309, where a "NO" decision is reached as the identifiers 707, 107 are different from one another. Hence, at the block 311, the notification device 401 may be controlled to emit a notification 751 of the identifiers 707, 107 being different (e.g., as depicted, the notification 751 may comprise a sound or light emitted from the notification device 401 as a warning). Furthermore, at the block 313, the read-write device 120 does not write the identifier 707 to the second memory 112. As also depicted in FIG. 7, the read-write device 120 may transmit a command 761 to the controller 420 to prevent the controller 420 from positioning the printhead assembly 101 and the accessory 109 to interact with each other prevent contamination of the printhead 703 by any residual fluid from the printhead 103 that may reside at the accessory 109. In some examples, the controller 420 may control the notification device 401 to emit the notification 751 in response to receiving the command 761.

Figure 8:
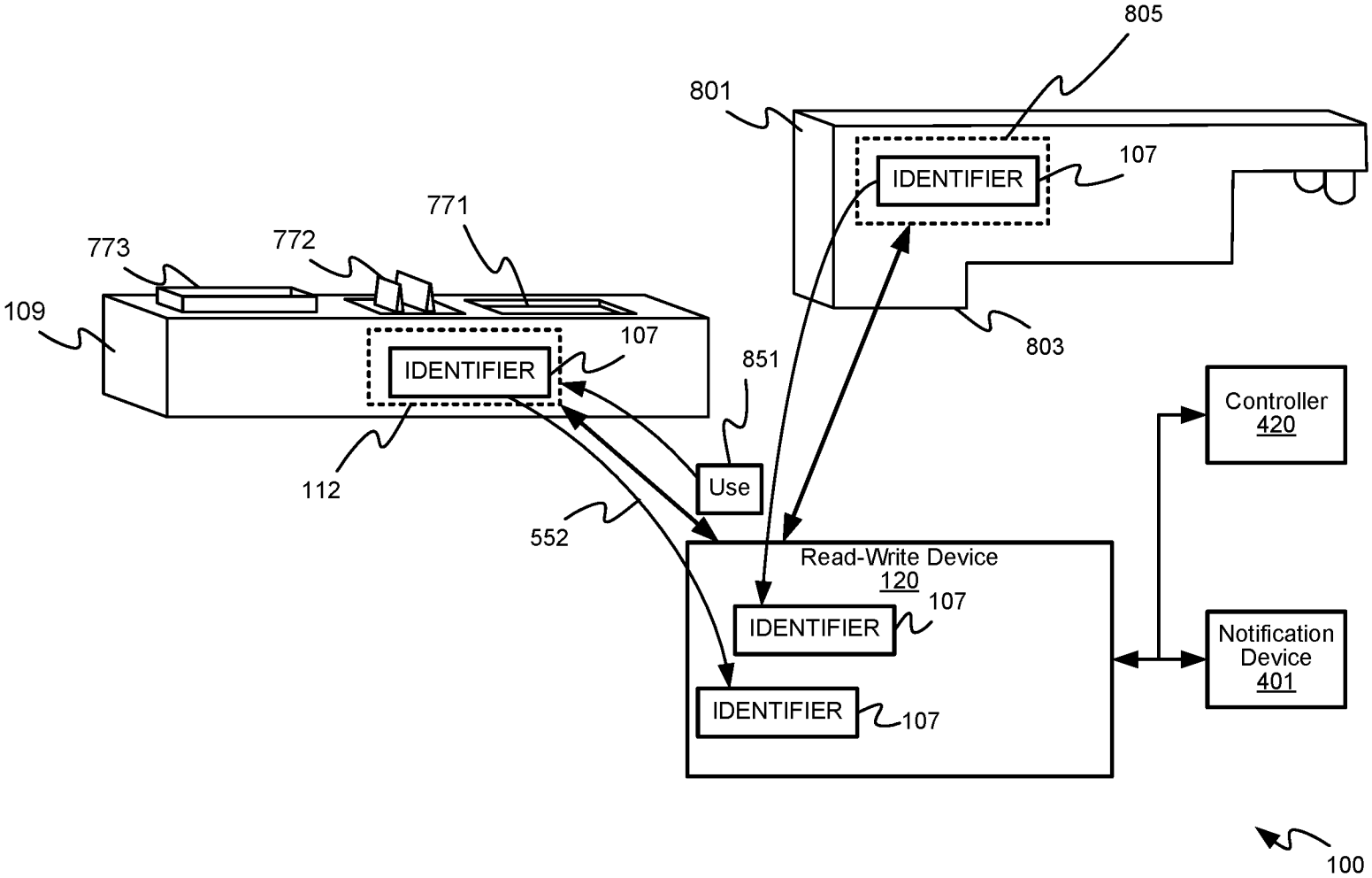
FIG. 8 shows the system of FIG. 1 implementing yet another portion of the example method for writing to a memory associated with an accessory of a fluid dispensing system.

Attention is next directed to FIG. 8, in which the accessory 109 stores the identifier 107, but the system 100 is now attempting to use another printhead assembly 801 with the accessory 109. The printhead assembly 801 is substantially similar to the printhead assembly 101 and hence comprises a respective printhead 803 and a respective memory 805. However, in contrast to the printhead assembly 701, the printhead assembly 801 is used to dispense the given fluid identified by the identifier 107 (e.g., the printhead assemblies 101, 801 dispense the same given fluid).

As such, when the read-write device 120 implements the method 300, at the block 301 and the block 303, the read-write device 120 reads the identifiers 107, 107 from the respective memories 805, 105 (e.g. via respective links). The read-write device 120 determines, at the block 305, that the second memory 112 stores the identifier 107 and hence compares the identifiers 107 at the block 309, where a "YES" decision is reached as the identifiers 107 are the same.

Hence, at the block 315, the read-write device 120 may write a use indication 851 of the accessory 109 to the second memory 112 to indicate a use of the accessory 109. While not depicted, the read-write device 120 may also read the number of use indications stored at the second memory 112 and prevent the accessory 109 from being used with the printhead assembly 801 when a number of use indications stored at the second memory 112 meets and/or exceeds a threshold number of use indications. In some of these examples, the read-write device 120 may transmit a command, similar to the command 761, to cause the controller 420 to prevent use of the accessory 109, for example via a notification provided by the notification device 401, and the like.

The techniques described above, a method for writing to a memory associated with an accessory of a fluid dispensing system, such as the method 300, may also be used with accessories used to connect fluid cartridges with printhead assemblies.

Figure 9:
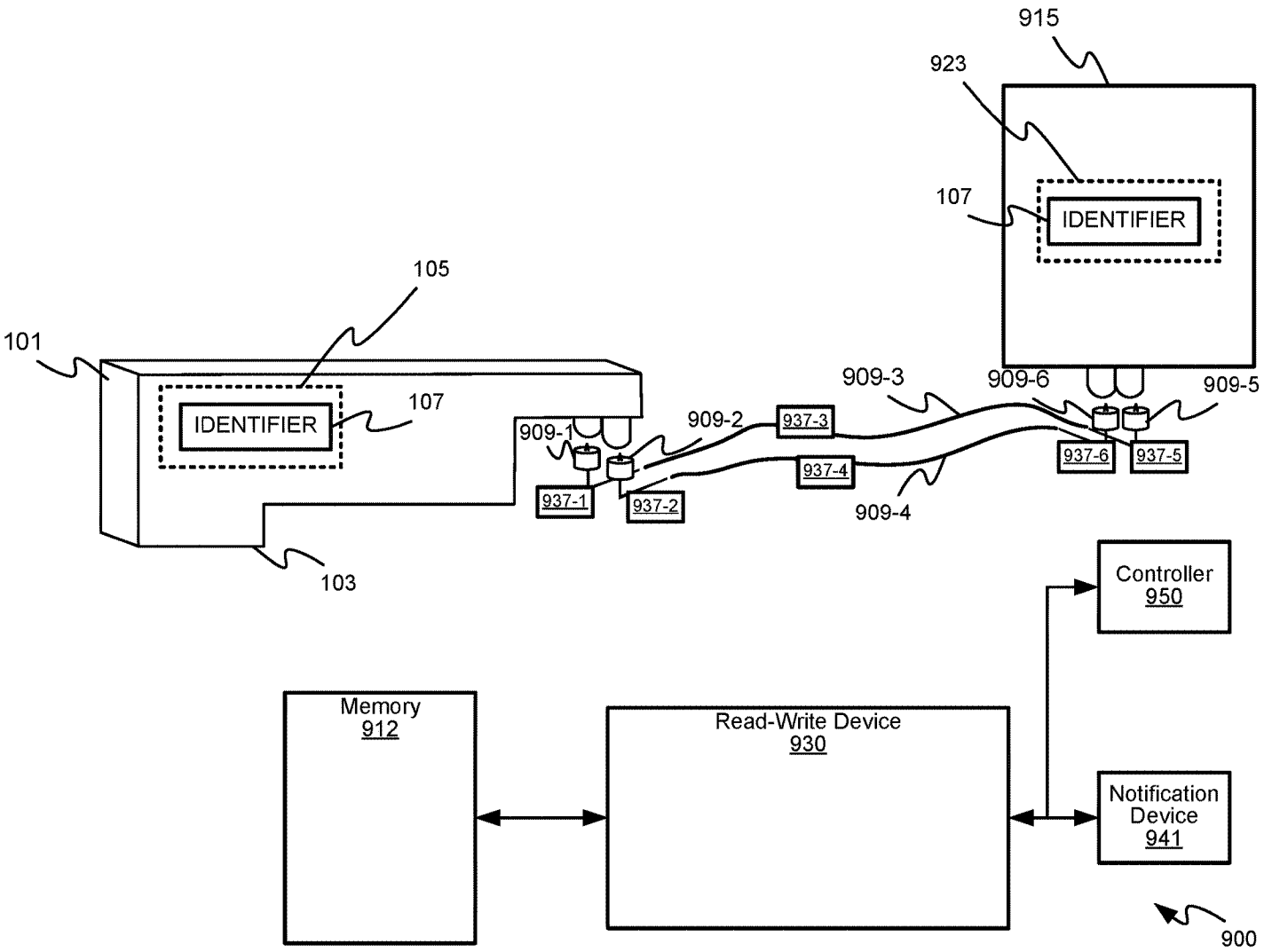
FIG. 9 shows a block diagram of another example fluid dispensing system before an example method for writing to a memory associated with an accessory of a fluid dispensing system has been implemented; and, FIG. 10 shows the system of FIG. 10 after an example method for writing to a memory with an accessory of a fluid dispensing system has been implemented.
Figure 10:
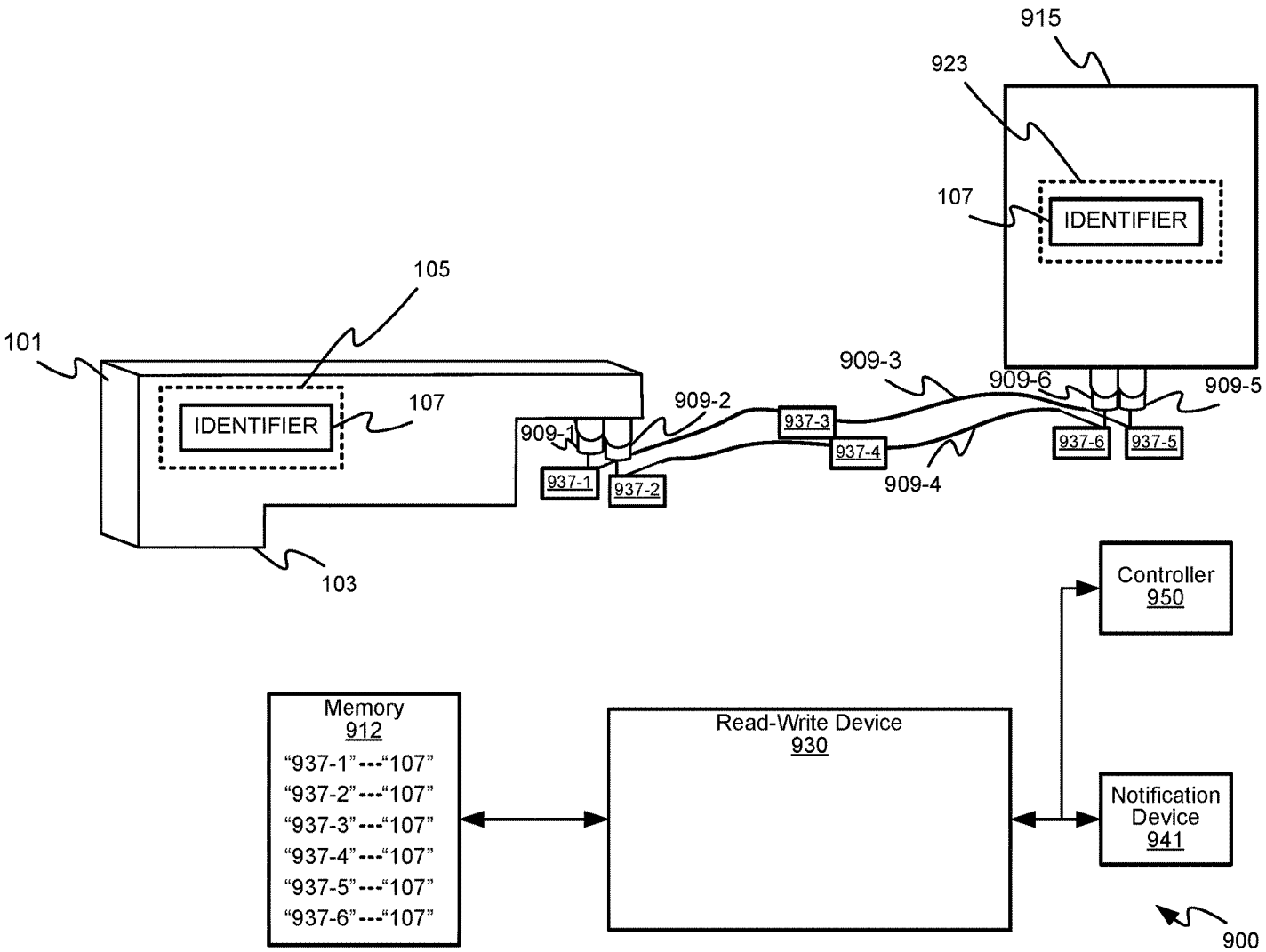

For example, attention is next directed to FIG. 9 and FIG. 10, each of which depicts a system 900 that includes the printhead assembly 101, including the printhead 103 and the first memory 105 storing the identifier 107 of the given fluid dispensed by the printhead assembly 101. In particular, FIG. 9 shows the system 900 before a method for writing to a memory associated with an accessory of a fluid dispensing system has been implemented, and FIG. 10 shows the system 900 after a method for writing to a memory associated with an accessory of a fluid dispensing system has been implemented.

The system 900 further includes a second memory 912 which may comprise a database device, and the like and which is described in more detail below.

The system 900 further includes a cartridge 915 (e.g. an fluid cartridge) storing the given fluid dispensed by the printhead assembly 101. The cartridge 915 comprises a third memory 923 storing the identifier 107 of the given fluid. Hence, the printhead assembly 101 and the cartridge 915 have been previously paired to dispense the given fluid identified by the identifier 107. Alternatively, the printhead assembly 101 may have previously used with another cartridge storing the given fluid identified by the identifier 107, and the cartridge 915 may be a replacement cartridge and/or another cartridge storing the given fluid identified by the identifier 107.

To connect the printhead assembly 101 and the cartridge 915, the system 900 further comprises an accessory and/or accessories 909-1, 909-2, 909-3, 909-4, 909-5, 909-6 to fluidly connect the cartridge 915 to the printhead assembly 101 such that the given fluid flows from the cartridge 915 to the printhead assembly 101 via the accessory and/or accessories 909-1, 909-2, 909-3, 909-4, 909-5, 909-6. The accessories 909-1, 909-2, 909-3, 909-4, 909-5, 909-6 are interchangeably referred to hereafter, collectively, as the accessories 909 and, generically, as an accessory 909.

For example, the accessories 909-1, 909-2, 909-5, 909-6 each comprise a respective septum, each including a respective needle, used to mate with and/or pierce a reagent-well of the cartridge 915, and/or used to mate with and/or pierce a reagent storage chamber of the printhead assembly 101. For example, a septum may be inserted into a respective receptacle for a septum at the printhead assembly 101 or the cartridge 915 (such receptacles depicted in FIG. 9 as cylinders extending from each of the cartridge 915 the printhead assembly 101 in FIG. 9). As depicted, two respective septums are used for each of the printhead assembly 101 and the cartridge 915 as, in the depicted examples, the printhead assembly 101 comprises two respective reagent storage chambers and the cartridge 915 comprises two reagent-wells. However, in other examples, as few as one septum may be used with each of the printhead assembly 101 and the cartridge 915, and in other examples more than two septums may be used with each of the printhead assembly 101 and the cartridge 915 depending, for example, on the number of reagent storage chambers and respective reagent-wells of each.

The accessories 909-3, 909-4 each comprise a respective tube to connect septums respectively mated with the printhead assembly 101 and the cartridge 915. For example, each septum a channel from the needle to an opposite end which mates with a tube. Hence, to connect the printhead assembly 101 to the cartridge 915, a septum may be attached to either end of a tube, and then each septum is respectively mated with the printhead assembly 101 and the cartridge 915.

Hence, an accessory 909 of the system 900 may comprise: a first septum for connecting to the printhead assembly 101; a second septum for connecting to the cartridge 915; a tube for connecting the first septum and the second septum; or a combination thereof.

As depicted, the system 900 further comprises a read-write device 930 to: read the identifier 107 of the given fluid from the first memory 105 or the third memory 923; read the second memory 912; and, when the second memory does not store a fluid identifier, write the identifier 107 of the given fluid to the second memory 912. The read-write device 930 may comprise the read-write device 120, or the read-write device 930 may be a different read-write device.

For example, as depicted, each of the accessories 909 comprise a respective printed identifier 937-1, 937-2, 937-3, 937-4, 937-5, 937-6 (interchangeably referred to hereafter, collectively, as the printed identifiers 937 and, generically, as printed identifier 937). Each printed identifier 937 may comprise a unique part number printed onto a respective accessory 909 and/or a tag thereof, for example, in the form of barcode, and the like.

Furthermore, in the depicted example, the second memory 912 is located remotely from the accessory 909 and/or the accessories 909, and the read-write device 930 is further to: read a printed identifier 937; and when the second memory 912 does not store a fluid identifier (e.g. in association with data corresponding to the printed identifier 937), write the identifier 107 of the given fluid to the second memory 912 in association with the printed identifier 937 (e.g. in association with data corresponding to the printed identifier 937). Hence, in these examples, the read-write device 930 is in communication with the second memory 912 via a wired and/or wireless link. With reference to FIG. 9, the second memory 912 initially does not store a fluid identifier. Indeed, FIG. 9 depicts the system 900 before any fluid identifiers are written to the second memory 912, and FIG. 10 depicts the system 900 after the identifier 107 of the given fluid is written to the second memory 912 in association with the printed identifier 937, as described hereafter. Furthermore, in FIG. 10, the accessories 909 are connected to each other, the printhead assembly 101 and the cartridge 915 such that fluid from the cartridge 915 flows to the printhead assembly 101 via the accessories 909.

Furthermore, in these examples, the read-write device 930 may read the first memory 105 and/or the third memory 923 to read the identifier 107.

The read-write device 930 may further include a camera and/or barcode reader to read the printed identifiers 937.

The read-write device 930 further determines whether the second memory 912 stores the identifier 107 in association with any of the printed identifiers 937 and/or data corresponding to the printed identifiers 937. When a printed identifier 937 and/or data corresponding thereto is not stored in association with any fluid identifier, the read-write device 930 writes the identifier 107 to the second memory 912 in association with the printed identifier 937 (e.g. in association with data corresponding to the printed identifier 937). For example, with reference to FIG. 10, the second memory 912 may store data corresponding to the printed identifiers 937 (e.g. "937-1", 937-2", "937-3", "937-4", "937-5", "937-6") in association with the identifier 107 (e.g. "107"), the association therebetween indicated in FIG. 10 by dashed lines.

However, when a printed identifier 937 of a given accessory 909, and/or data corresponding thereto, is stored in association with a fluid identifier different from the identifier 107, the read-write device 930 does not write the identifier 107 to the second memory 912; and/or a notification device 941 (e.g. similar to and/or the same as the notification device 401) is controlled to provide a notification thereof; and/or the read-write device 930 transmits a command to a controller 950 (e.g. similar to and/or the same as the controller 420) to prevent the given accessory 909 from being used with the printhead assembly 101 and/or the cartridge 915.

However, in other examples, an accessory 909 may include a second memory and the read-write device 930 may read the second memory of the accessory 909 to determine whether the second memory stores the identifier 107 or another fluid identifier.

Indeed, the system 100 and the system 900 may be combined to prevent contamination of printhead assemblies by either the accessory 109 or the accessories 909.

It should be recognized that features and aspects of the various examples provided above may be combined into further examples that also fall within the scope of the present disclosure.

The invention claimed is:

1. A fluid dispensing system comprising:

a printhead assembly comprising: a printhead to dispense a given fluid in a printing process; and a first memory storing an identifier of the given fluid;

an accessory to interact with the printhead in a cleaning process or a storage process;

a second memory that is located with the accessory; and a read-write device to: read the identifier of the given fluid from the first memory; read the second memory; and, when the second memory does not store a fluid identifier, write the identifier of the given fluid to the second memory.

2. The fluid dispensing system of claim 1, wherein the accessory comprises a wiper to wipe the printhead during the cleaning process.

3. The fluid dispensing system of claim 1, wherein the accessory comprises a cap device to cap the printhead during the storage process.

4. The fluid dispensing system of claim 1, wherein the accessory comprises a service station used in the cleaning process or the storage process.

5. The fluid dispensing system of claim 1, wherein the accessory comprises a service station including: a wiper to wipe the printhead during the cleaning process; a cap device to cap the printhead during the storage process; or a priming spittoon to receive excess fluid from the printhead during the cleaning process or the storage process.

6. A method comprising:

reading, using a read-write device, an identifier of a given fluid from a first memory associated with a printhead assembly, the given fluid dispensed by the printhead assembly;

reading, using the read-write device, a second memory associated with an accessory to interact with the printhead assembly in a cleaning process or a storage process; and when the second memory does not store a fluid identifier, writing, using the read-write device, the identifier of the given fluid to the second memory.

7. The method of claim 6, further comprising:

reading, using the read-write device, the second memory at the accessory, the accessory comprising the second memory.

8. The method of claim 6, further comprising:

reading, using the read-write device, the second memory at a service station to hold the accessory, the service station comprising the second memory.

9. The method of claim 6, further comprising:

when the second memory stores another fluid identifier different from the identifier of the given fluid, controlling, using the read-write device or a controller, a notification device to provide a notification thereof; and not writing, using the read-write device, the identifier of the given fluid to the second memory, or preventing the printhead assembly from being used with the accessory.

10. The method of claim 6, further comprising:

when the second memory already stores the identifier of the given fluid, writing, using the read-write device, a use indication of the accessory to the second memory.

11. A fluid dispensing system comprising:

a printhead assembly comprising a first memory storing an identifier of a given fluid dispensed by the printhead assembly;

a second memory;

a cartridge storing the given fluid, the cartridge comprising a third memory storing the identifier of the given fluid;

an accessory to fluidly connect the cartridge to the printhead assembly such that the given fluid flows from the cartridge to the printhead assembly via the accessory, the second memory associated with the accessory; and a read-write device to: read the identifier of the given fluid from the first memory or the third memory; read the second memory; and, when the second memory does not store a fluid identifier, write the identifier of the given fluid to the second memory.

12. The fluid dispensing system of claim 11, wherein the accessory comprises the second memory.

13. The fluid dispensing system of claim 11, wherein the accessory includes a printed identifier, the second memory is located remotely from the accessory, and the read-write device is further to: read the printed identifier; and when the second memory does not store the fluid identifier, write the identifier of the given fluid to the second memory in association with the printed identifier.

14. The fluid dispensing system of claim 11, further comprising a notification device, and wherein the read-write device is further to: when the second memory stores another fluid identifier different from the identifier of the given fluid, do not write the identifier of the given fluid to the second memory and control the notification device to provide a notification thereof.

15. The fluid dispensing system of claim 11, wherein the accessory comprises: a first septum for connecting to the printhead assembly; a second septum for connecting to the cartridge; a tube for connecting the first septum and the second septum; or a combination thereof.

* * * * *